United States Patent [19]

Joosten

[11] 3,961,391

[45] June 8, 1976

[54] SHOE-HEEL DRESSING OR ROUGHENING MACHINE

[75] Inventor: Hendrik Joosten, Eindhoven, Netherlands

[73] Assignee: Bata Shoe Company, Inc., Belcamp, Md.

[22] Filed: Dec. 13, 1973

[21] Appl. No.: 424,332

[52] U.S. Cl. ..... 12/46; 51/74 R
[51] Int. Cl.[2] ..... A43D 87/00; B24B 7/00
[58] Field of Search ..... 12/46, 46.5, 47.1; 51/74 R, 112

[56] References Cited

UNITED STATES PATENTS

| | | | |
|---|---|---|---|
| 2,065,645 | 12/1936 | Brooks et al. | 12/46 |
| 2,319,298 | 5/1943 | Clausing | 12/46 |
| 2,725,581 | 12/1955 | Pickford | 12/46 |

*Primary Examiner*—Patrick D. Lawson
*Attorney, Agent, or Firm*—Holman & Stern

[57] ABSTRACT

Apparatus for dressing a shoe-heel surface to be adhesively secured to a shoe-upper in which means are provided to move shoe-heels one-by-one into a work position confronting the work surface of a disc-shaped dressing brush mounted on an axis of rotation; the brush shaft being driven by an electro-motor or the like and being operatively connected to a rotatable mounting axis intersecting the axis of rotation of the brush and generally perpendicular thereto and a mechanism adjustable to automatically provide the convex working brush surface with an eliptical-shaped path during 360° of rotation of the mounting axis for dressing a shoe surface from within the area of the shoe-heel perimeter toward the outer sides of the heel whereby a generally dish-shaped dressed surface is formed and the optimum adhering-edges are provided at the dressed heel surface; and in which the machine is adjustable for different shaped heels.

8 Claims, 4 Drawing Figures

SHOE-HEEL DRESSING OR ROUGHENING MACHINE

FIELD OF THE INVENTION

Apparatus to roughen or dress the upper surface of shoe heels before the upper surface of the shoe is adhered to the shoe-upper, i.e., by roughening or dressing the upper surface adhesion to the shoe-upper is improved. In this regard, the invention particularly concerns natural rubber or synthetic resin heel-dressing, however, the present invention is not limited to such materials, i.e., cork, wood etc. can be dressed on the apparatus as will become apparent.

BACKGROUND OF THE INVENTION

Machines are known, which roughen or dress the upper surface of a heel by means of a roughening brush, which rotates around an axis perpendicularly to the work-surface of said brush and the upper surface of the heel is roughened by the circumferential surface of said brush. During this procedure, the heel is clamped while being roughened, with its upper surface exposed to said roughening brush; the known machines, in practice, have not proven satisfactory since the shoe-heel periphery is often mutilated and the heel does not seat properly on the shoe-upper or adhesive may leak past mutilated heel-margins.

SUMMARY OF THE INVENTION

A primary object of the invention is to provide a heel roughening or dressing machine, that is suitable for automatically roughening heels which comprise: means for producing a flat, concave and dish-shaped upper surface, and for milling excavations in flat upper heel surfaces, and forming an acute angled upper surface on the heel, which is dressed in a single operation, about the entire heel periphery; and producing thin tapering adhesion edges at the upper heel surface, without damaging such edges and without bending them up to the inner side of the heel, and compensating for differences in height and cambers in the upper heel surface being dressed.

More particularly, the invention concerns a shoe-heel roughening machine comprising a dressing brush, which is rotatable by means of a power source; an electromotor, for example, around a central axis of rotation, which is parallel to the work surface of the dressing brush, and a mechanism that clamps a heel during the dressing of its upper surface; the upper heel-surface, confronting the circumferential plane of said roughening brush; the machine having a major feature in that said roughening brush includes a rotatable mounting axis, which at one side perpendicularly crosses the axis of rotation of the roughening brush and which on the other hand is connected to a driving gear, which effects, on rotation of the mounting axis, the circumferential surface of said roughening brush, during its rotation about its own axis of rotation, and displaces the brush on a generally circular path over the upper surface of the heel being dressed; said circular path being alterable into an ellipse-shaped path because said rotatable mounting axis is connected to an eccentric mechanism, which gives said mounting axis, while rotating, together with the dressing brush a generally to-and-fro tilting movement in one direction. Due to said mechanism, the roughening brush can be displaced in a circular or ellipse-shaped path over the surface of the heel to be dressed or roughened, the choice of a circular or ellipse-shaped path being determined by the model or shape of the heel. Notwithstanding the type of path chosen, the roughening brush carries out all movements required on the surface of the heel to be dressed or roughened, within the perimeter of the heel, and functions to effect the direction of the roughening are always from within the shoe perimeter toward the outer boundary or sides of the heel surface being dressed, so that tapering adhesion edges are avoided, to obviate a type of damage prevalent presently occuring in the prior art. Moreover, it is possible, owing to the tilting movement of said mounting axis, to roughen or dress flat surfaces as well as concave and dish-shaped upper surfaces of heels, since the generally ellipse-shaped path which is completed by said roughening or dressing brush, is not in a flat surface but in a more or less moved in a concave plane; this occuring as a result of the tilting movement.

In essence, the machine is provided with means, by which the radius of the circular path of brush movement is adjusted with respect to the length of the tilting path of the rotatable axis, and therefore the length of the ellipse, can be altered, and thus adapted to the dimensions of the heel-surface being dressed.

According to another feature of the machine, according to the invention, the driving gear of said rotatable mounting axis is arranged so that the roughening brush work surface describes only one circular or ellipse-shaped path over the upper surface of the heel; i.e., the rotatable mounting axis makes a single rotation of 360° per heel and therefore, the dressing or roughening of heels requires little time and this leads to a high production.

The above mentioned and other objects and advantages of the invention will become apparent from the following description with reference to the drawing forming a part thereof in which a preferred embodiment of the machine which is shown by way of example only, the invention, however, is not limited to said exemplary embodiment; in which:

DESCRIPTION OF THE PREFERRED EXEMPLARY EMBODIMENT

Figure 1:
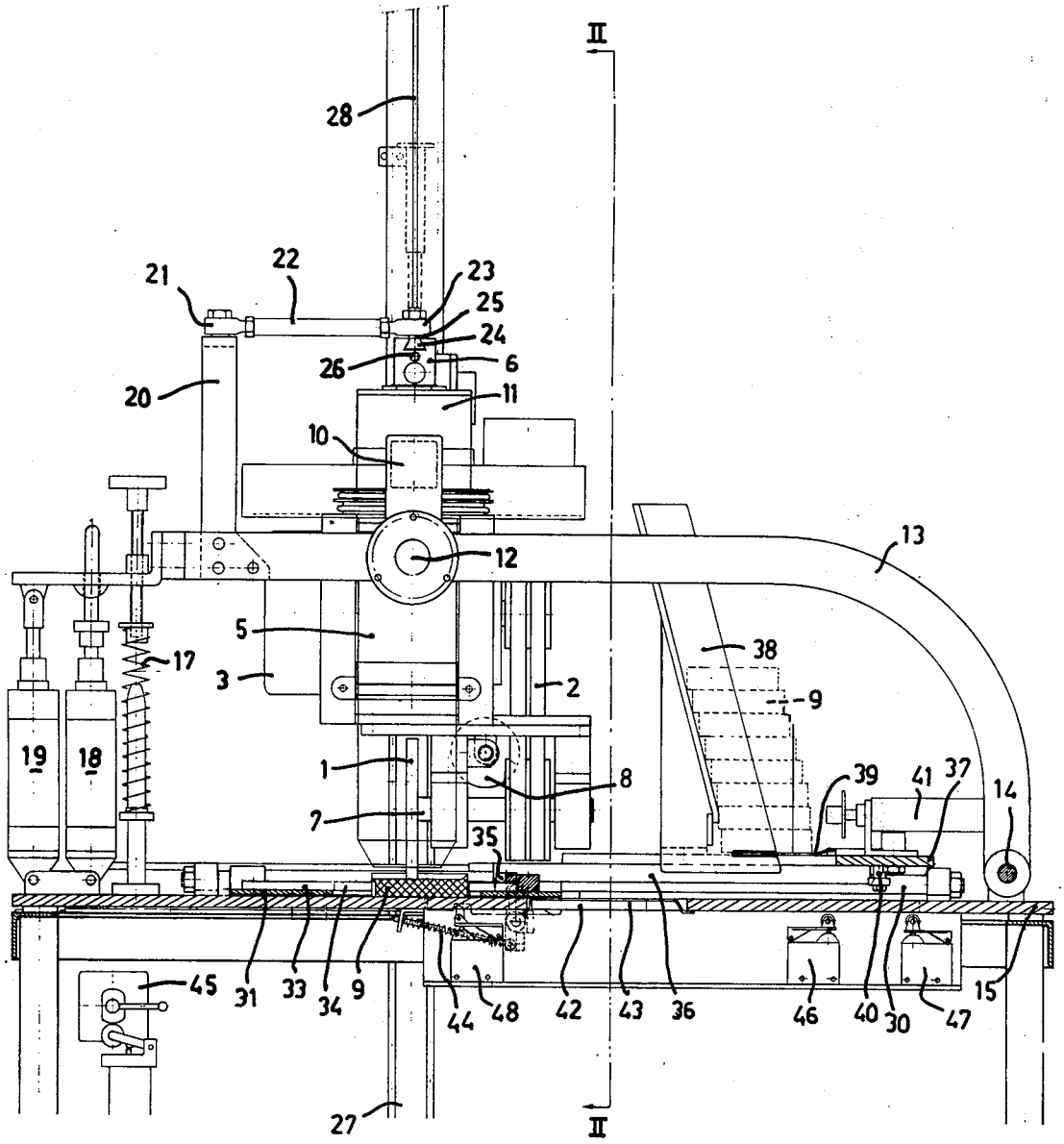
FIG. 1 is a side elevational view, taken substantially on the plane of line I—I in FIG. 2.
Figure 2:
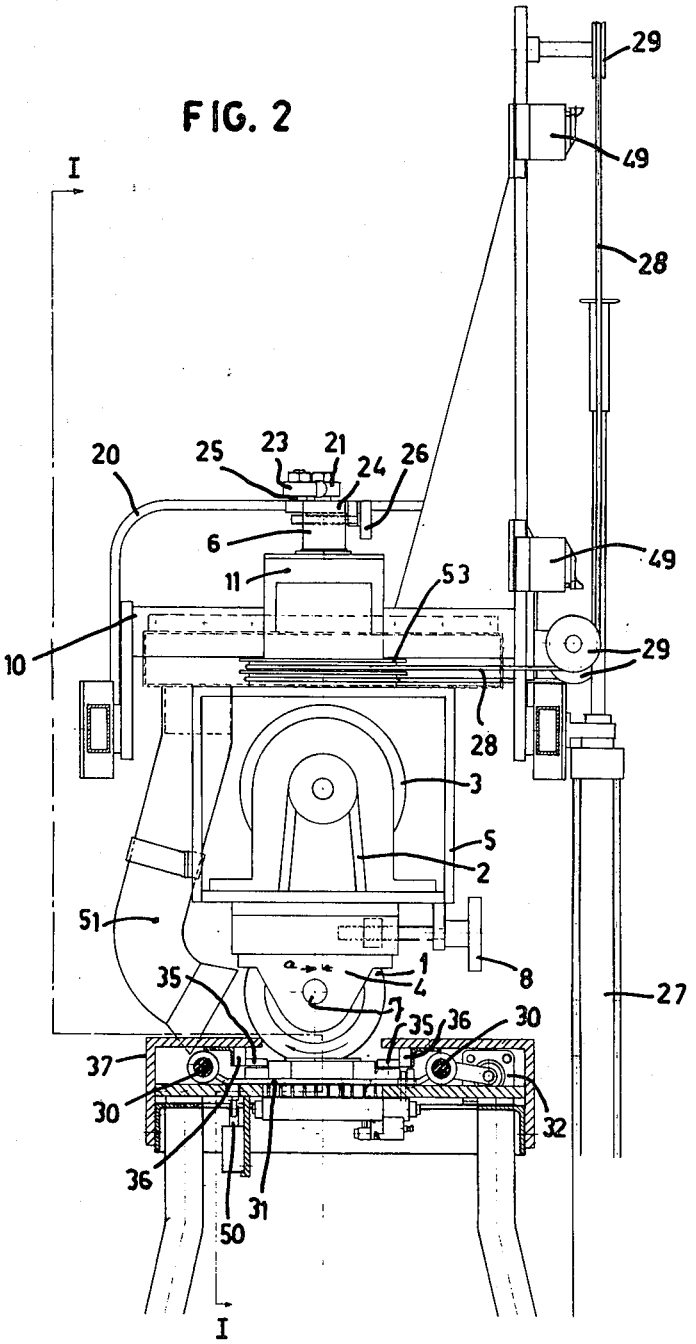
FIG. 2 is a vertical section taken substantially on the plane of line II—II on FIG. 1.

Referring to FIGS. 1 and 2, a cylindrical steelwire roughening or dressing brush 1 is driven about a shaft 7 through a V-belt drive 2 by an electromotor 3, mounted on a rectangular frame 5 (see FIG. 2) as are the bearings 4 of the roughening brush 1. The frame is connected to a vertical shaft 6 extending from the upper side of the frame 5 and the roughening brush is rotatable about its own horizontal shaft or axis of rotation 7 at a considerable speed, i.e., at about 2000 revolutions per minute. The shaft 7 of the brush 1 is disposed perpendicularly to the shaft 6 and the axis of the shaft 6 is in a plane that intersects the center of the width of the roughening brush (FIG. 1). In its plane, the brush 1 is adjustable with respect to the frame 5 (FIG.

2) since the bearings 4, upon which shaft 7 is journaled, are slidable along the bottom of the frame, by means of an adjusting screw 8. The shafts 6 and 7 perpendicularly cross each other in an off-set position of a distance *a* (FIG. 2). In this position, the plane of the roughening brush, which is tangent to the upper surface of a heel 9 to be roughened, describes a circular path if the frame 5 and its shaft 6 are rotated. The size of the radius of the circular path of rotation is therefore determined by the adjustable distance *a*.

Figure 3:
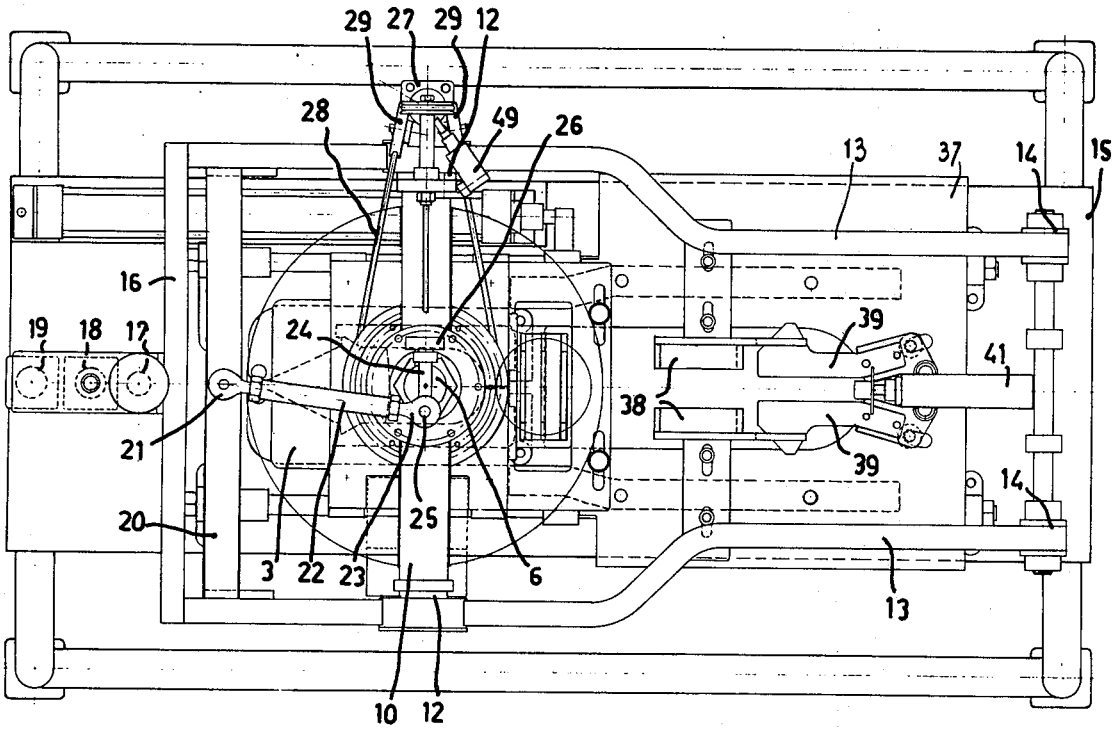
FIG. 3 is a top plan view of the machine.

The frame 5 and the shaft 6 connected therewith are rotatable in a tubular portion 11 of a tiltable transverse connector 10. The transverse connector rotates by means of two opposed journals 12 mounted in two, mutually parallel curved levers 13, these levers 13 are connected on one end with a sole plate 15 by means of a pivot 14. At their other ends, the levers 13 are mutually connected by means of a transverse rod 16; see FIG. 3, and they are supported by a compression spring 17, adjusted to attain a prescribed roughening pressure to be exerted on the heel 9 being dressed. Further, a pneumatic cylinder 18 and a damping cylinder 19 also engage the transverse rod 16. Due to the spring-mounted levers, the roughening brush follows automatically differences in height and cambers, if any, in the heel surface being dressed and roughened, irrespective of the direction in which said differences in height and cambers extend; all this being accomplished by the maintenance of the adjusted roughening pressure.

At a point between the journals 12 for housing 11, and the transverse rod 16, the levers 13 support a vertically disposed crossbar 20; the crossbar is medially connected to one end of a driving rod 22, by a self-adjusting bearing 21. The other end of the driving rod 22 is connected to the upper end of the vertical shaft 6 by means of a self-adjusting bearing 23. A wedge piece 24 is transversely slidable in a central wedge slot in the upper end of the shaft 6 and one end of the wedge piece 24 supports the bearing 23 on a vertical pin 25. The wedge piece is adjustable with respect to the shaft 6, perpendicularly to the axis of the shaft, by means of an adjusting screw 26. Thus, the size of the eccentricity of an eccentric mechanism comprising elements 24, 25, is adjustable. In this way, the dimensional relationships of the eccentric mechanism can be influenced. The function of the eccentric mechanism is that a slight tilting adjustment movement of the shaft 6 and the frame 5 about the journals 12 is possible during rotation of the frame 5 with roughening brush 1 and shaft 6. The circular path, which is completed by the roughening brush over the heel surface, is thus changed into an ellipse-shaped path, with the long ellipse axis extending in the longitudinal direction of the heel, which, in the embodiment as shown, has its longitudinal axis perpendicular to the journals 12.

Adjacent to one of the journals 12 (see FIG. 2), the tiltable transverse connection 10 carries a vertical pneumatic cylinder and piston mechanism 27. This cylinder or fluid motor is adapted to rotate the frame 5 and the shaft 6 through the action of a cable 28 that passes over guide rolls 29 and is looped around a cable drum 53 of the frame 5. This driving mechanism 27–29, 53 is arranged so that only one stroke over 360° is required per heel, alternatingly from left and then to the right as successive heels are positioned beneath the brush at a position to be dressed.

The machine operates through automatic supply and discharge of heels. The mechanism for automatic control (see FIGS. 2 and 3) comprises two parallel guide rods 30 on the base plate 15 and a carriage 31 slidable to and fro along the guide rods by means of a pneumatic piston and cylinder mechanism 32. The carriage has two pivotable clamping plates 33 and the plates are each provided with interchangeable heel moulds 34, adapted to the size of the heels being dressed. The heel moulds are pressed away from each other by a suitable compression spring and include travelling rollers (FIGS. 1 and 2) that roll along fixed guide rails 36 and that draw the clamping plates 33 towards each other during the transport movement of the carriage, pressing against the heel; this occurs against the pressure of the compression spring.

The guide rails 36 are attached to a fixed intermediate frame 37 which supports a storage hopper 38 in which the heels 9 to be roughened are stacked with the upper surface to be dressed facing upwards. The hopper 38 has at its lower end an opening which is normally closed by pivotable closing plates 39; see FIG. 3, and these plates can be swung open by the carriage 31, through levers 40 which are provided at the lower surface of the intermediate frame 37. The intermediate frame 37 also supports a pneumatic piston and cylinder mechanism 41 which engages the heel 9 that lies immediately above the heel that has fallen out of hopper 38 and which mechanism, in this way, temporarily holds the stack of heels. The base plate 15 is provided with an opening 42 with a trap-door 43 which is maintained closed by a spring 44. The trap-door 43 can temporarily be opened by movement of the carriage 31, which action is explained below.

OPERATION

The machine operates as follows. By switching on a main switch 45, the motor 3 starts, and the carriage 31 approaches the heel hopper 38 (in FIG. 1 from the left to the right). The closed plates 39 are opened by the carriage 31, through the levers 40. The lowermost heel falls from the hopper and between the moulds 34. A valve 46 is operated so that the piston-cylinder mechanism 41 prevents the remaining heels in the hopper from falling out. When the carriage reaches the right-hand final position in FIG. 1, a valve 47 is operated for a moment, and a valve, that is connected to the piston cylinder mechanism 32 is changed over, so that the piston of said mechanism is drawn backwards, as a result of which the carriage 31 in FIG. 1 displaces itself to the left and the plates 39 are closed. When the carriage approaches its left hand final position in FIG. 1, the clamping plates 33 are pressed towards each other by guide rails 36, so that the heel to be roughened is clamped into the carriage. When the carriage reaches its left hand final position in FIG. 1, the piston of the pneumatic cylinder 18 is drawn backwards and the roughening brush which is rotating about its shaft 7, descends onto the heel surface to be roughened. Simultaneously, the piston and cylinder mechanism 27 becomes active and causes the frame 5 and the roughening brush 1 to rotate about the vertical shaft 6 over 360°. During the roughening operation, the damping cylinder 19 compensates or dampens the vertical movements of the whole upper portions of the machine, whereas the adjustable compression spring 17 maintains the desired roughening pressure.

When the shaft 6, together with the roughening brush 1, has rotated over 360°, one of the valves is actuated by the piston-cylinder mechanism 27. As a result thereof, the roughening brush is lifted by the piston-cylinder mechanism 18, and the piston of the mechanism 32 starts its retraction stroke, i.e., the carriage in FIG. 1 moves to the right. After the carriage has covered a prescribed distance, the clamping plates 33 are separated and the carriage opens the trap-door 43 by means of a trip-lever 50. Then the roughened heel falls out through the opening 42, after the carriage has passed, the trap-door 43 again closes the opening, by means of the spring 44, and the next cycle starts.

The machine has been provided with a dust suction pipe 51 that, in the embodiment as shown, has been mounted such that it follows the rotating movement of the roughening brush.

Figure 4:
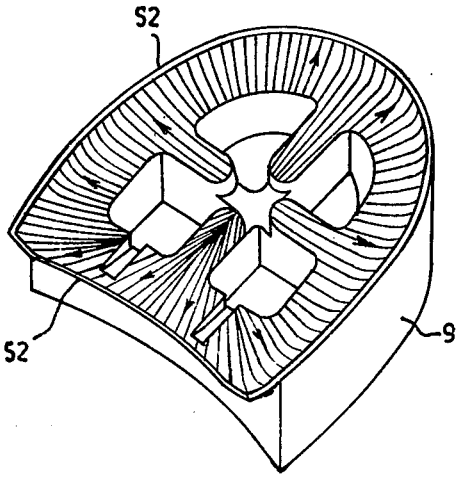
FIG. 4 is an enlarged perspective view of a heel, that has been roughened or dressed by the machine according to the invention.

FIG. 4 shows an example of a heel 9, that has been dressed by the machine according to the invention. The upper surface of the heel as shown has already been roughened or dressed and dished out. The arrows indicate that the roughening action took place from the inner to the outer margins 52, and as previously mentioned thin tapering adhesion edges are not bent or damaged on roughening.

The invention is not limited to the described and illustrated preferred embodiment of the machine, nor to the treatment of the heels of the described and shown embodiment, but comprises all embodiment variations that fall within the scope of the appended claims.

What is claimed is:

1. In a heel dressing machine including a roughening brush, connected to a power source for rotation about a central axis of rotation, the axis of rotation being parallel to the work surface of the roughening brush; and a mechanism for clamping a heel during dressing of an upper surface confronting the circumferential plane of rotation of said brush, characterized in that said brush is connected to a rotatable axis, which crosses at one side perpendicular said axis of rotation of said brush and which is connected through driving means, which effects on rotation of the axis a circumferential plane for said brush, during the rotation about its axis of rotation, and in which the work surface of the brush is on a circular path over the upper surface of the heel to be roughened, means for changing the circular path into an ellipse-shaped path, said means comprising an eccentric mechanism connected to the rotatable axis which causes said axis, while rotating, to effect a to-and-fro tilting movement in one direction.

2. In a machine according to claim 1, characterized by adjusting means between the brush axis of rotation and the rotatable axis for adjusting them relative to each other for defining the radius of the circular path through which said rotating brush is moved.

3. In a machine according to claim 1, characterized by adjusting means, operatively connected with the eccentric mechanism for adjusting the length of the tilt path of the rotatable axis for adjusting the ellipse major axis.

4. In a machine according to claim 1, characterized in that the driving means of said rotatable axis includes operating portions operatively connected to the brush for moving the brush through a single orbit through 360° for effecting only one circular or ellipse-shaped path over the upper surface of a heel being dressed.

5. In a machine according to claim 1, characterized in that the driving means is operatively connected to said rotatable axis by a frame, said frame supporting both the rotatable axis and the roughening brush, said frame being rotatably supported by a cross connection tiltably supported at opposite ends by journals disposed in mutually parallel levers, extending on opposite sides of the frame, said levers being pivotally connected at one end to a fixed sole plate on the machine and being mutually connected on the other end by a transverse rod supporting a pivotable driving rod on a vertical crossbar, said driving rod being pivotably connected, above said journals, to said eccentric mechanism, operatively connected to the upper and of the rotatable axis.

6. In a roughening machine according to claim 5, characterized in that the driving means of frame and rotatable axis comprises a piston- and cylinder mechanism operatively connected to one of the journals and a cable guided on guide rolls, said cable being connected between said piston and looped about a portion of said frame so that with each piston stroke the cable rotates the frame about the axis over 360°, alternatingly in a clockwise or counter-clockwise movement.

7. In a machine according to claim 1, characterized by heel clamping mechanism comprising a carriage, slidable to-and-fro along guide rods between a position beneath the brush in which a heel to be dressed and a hopper from which a heel is dispensed one-by-one, two pivotable clamping plates including heel moulds displaceable to a position in which the heel is dispensed under the roughening brush and clamped in said moulds between the clamping plates, said moulds being displacable relative to each other by means of travelling rollers movable along fixed guide rails.

8. In a machine according to claim 7, characterized in that said heel hopper has at a lower portion an opening for said heels, said opening normally being closed by two pivotable closing plates including means for causing the plates to open in relation to movement of said carriage, levers connected to a fixed intermediate frame supporting both said fixed guide rails and the heel hopper.

* * * * *